United States Patent [19]

Boyd

[11] Patent Number: 4,867,576

[45] Date of Patent: Sep. 19, 1989

[54] TRASH BAG WITH INFLATABLE RIM

[76] Inventor: E. Gordon Boyd, 358 Delaware St., Denver, Colo. 80223

[21] Appl. No.: 198,480

[22] Filed: May 25, 1988

[51] Int. Cl.[4] ..... B65D 33/00

[52] U.S. Cl. ..... 383/33; 383/3; 383/73

[58] Field of Search ..... 383/33, 3, 73, 71; 220/403, 404

[56] References Cited

U.S. PATENT DOCUMENTS

| | | | |
|---|---|---|---|
| 3,006,396 | 10/1961 | Cushman | 383/3 |
| 3,158,188 | 11/1964 | Esty | 383/3 |
| 3,742,994 | 7/1973 | Pensak | 383/3 |
| 4,026,340 | 5/1977 | Sobocik | 383/33 |
| 4,364,425 | 12/1982 | Mainville | 383/72 |
| 4,651,360 | 3/1987 | Wang | 383/3 |
| 4,705,085 | 11/1987 | Brown | 383/3 |

FOREIGN PATENT DOCUMENTS

| | | | |
|---|---|---|---|
| 537769 | 7/1941 | United Kingdom | 383/33 |

*Primary Examiner*—Willis Little

*Attorney, Agent, or Firm*—Brian D. Smith

[57] ABSTRACT

A flexible bag such as a trash bag is disclosed. The bag includes a flexible bag body having an open end with inflatable means located at the open end of the bag for maintaining the open end of the bag in an open position so that matter can be easily deposited into the bag through the bag's open end. In a preferred embodiment, the inflatable means includes a chamber-defining, inflatable rim which extends substantially around the open end of the bag body. An inflating means such as a valve or sealable stem-like member is also provided in communication with the chamber of the inflatable rim for receiving air to inflate the inflatable rim. The inflatable rim, when inflated, significantly enhances the ease with which matter may be deposited into the bag by defining an opening for receiving such matter.

16 Claims, 1 Drawing Sheet

TRASH BAG WITH INFLATABLE RIM

TECHNICAL FIELD

The invention relates generally to flexible bags such as trash bags having an open end and, more particularly, to trash bags having an open end and means for maintaining the open end of the bag in an open position.

BACKGROUND OF THE INVENTION

The problem of trying to hold open the open end of a trash bag while raking leaves into the bag is a difficult one, the difficulty of which is well documented in U.S. Pat. Nos. 3,942,832; 4,159,139 and 4,548,372. Each of these patents discloses a different solution to the problem. However, each solution utilizes a mechanical support structure of some sort to hold the mouth or open end of the bag open. While the support structures disclosed in these patents undoubtedly work as intended, it would be desirable if the open end of such a bag could be kept open without having to use a mechanical support structure. Obviating the need for such would not only eliminate the expense of having to buy such a support structure but would also eliminate the time and difficulty of attaching such a support structure to the open end of the bag.

Other patents disclosing means for holding the mouth or open end of a bag or sack open are disclosed in U.S. Pat. Nos. 4,048,691; 3,934,803; and 4,341,410.

DISCLOSURE OF THE INVENTION

The present invention addresses the aforementioned problems by providing a flexible bag such as a trash bag having an open end with inflatable means located at the open end of the bag for maintaining the open end in an open position when the inflatable means is inflated. As such, matter such as refuse and leaves, etc., can be easily deposited into the bag through the bag's open end when the inflatable means is inflated. The bag of the present invention also includes an inflating means such as a valve or stem-like member for receiving air to inflate the inflatable means.

In a preferred embodiment of the present invention, the flexible bag includes a bottom, an inflatable rim and a single layered sidewall extending between the bottom and the inflatable rim. The inflatable rim defines an open end of the bag which is maintained in an open position when the inflatable rim is inflated. As such, the inflatable rim, when inflated, defines an opening for receiving matter to be deposited in the bag.

The present invention also provides a method for maintaining the open end of a flexible bag such as a trash bag in an open position. The method includes the steps of providing the open end of a bag with inflatable means and inflating the inflatable means to maintain the open end of the bag in the open position. The method further preferably includes the step of sealing the inflatable means after it has been inflated to prevent it from deflating.

The present invention further provides a method of providing a flexible bag having an open end with an inflatable rim that extends substantially around the bag's open end. The method includes the steps of turning a selected portion of the open end of the bag inside out; heat sealing a selected exposed portion of the outturned open end to an underlying surface of the bag to provide the bag with the inflatable rim; and providing inflating means in communication with the interior of the inflatable rim for receiving air to inflate the inflatable rim.

BRIEF DESCRIPTION OF THE DRAWINGS

Other features of this invention will appear in the following description and appended claims, reference being made to the accompanying drawings forming a part of the specification with like reference characters des corresponding parts in the views.

DETAILED DESCRIPTION OF THE DRAWINGS

Figure 1:
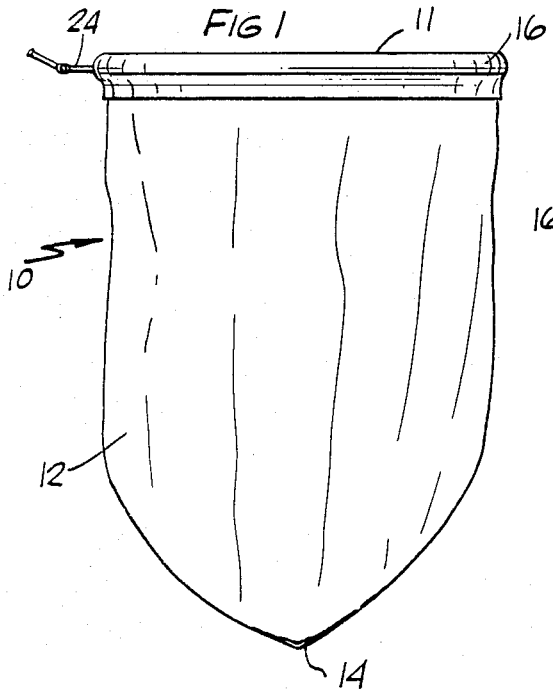
FIG. 1 is a side elevational view of a trash bag of the present having an inflatable rim.
Figure 2:
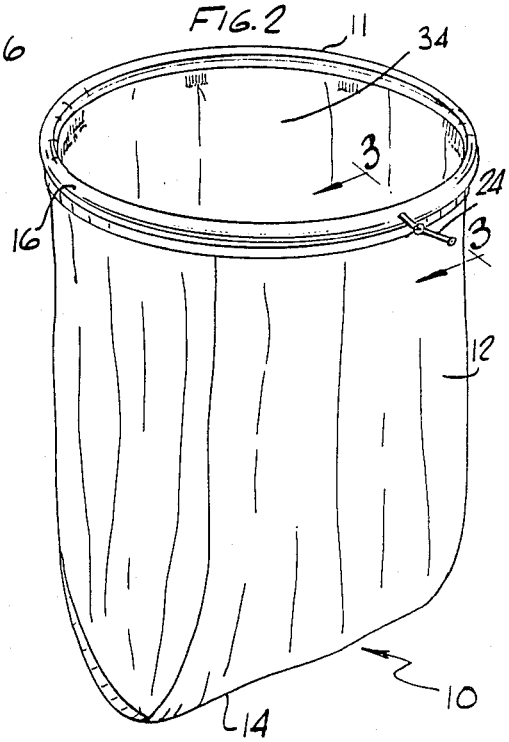
FIG. 2 is a perspective view of the trash bag illustrated in FIG. 1.
Figure 3:
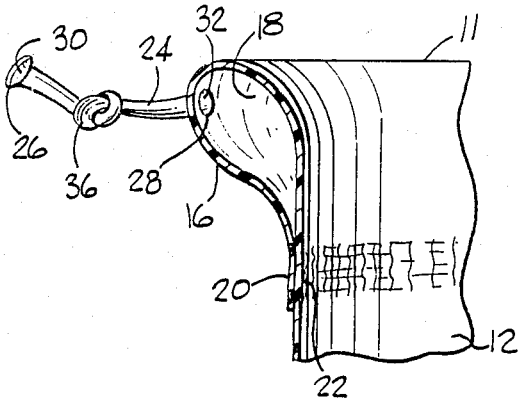
FIG. 3 is a partial cross-sectional view of the inflatable rim the bag taken along lines 3—3 of FIG. 2.

FIGS. 1 through 3 illustrate a flexible trash bag 10 of the present invention having an open end 11. Bag 10 is preferably made from a sheet of flexible, heat sealable material such as vinyl, polyethylene, a plastic coated material or a rubberized material. The sheet of material may be single ply or it may be a flexible multi-ply laminate.

Bag 10 has a sidewall or bag body 12 made from a single sheet or layer of the aforementioned flexible, heat sealable material. As best illustrated in FIG. 2, sidewall 12 extends fully around the bag to provide the bag with its generally cylindrical shape. While generally cylindrical, the lower end (not numbered) of the sidewall converges to form a bottom 14 of the bag. Bottom 14 is preferably formed by heat sealing one half of the bottom edge (not numbered) of sidewall 12 to the other half of the bottom edge of sidewall 12. The heat sealing process for forming bottom 14 is essentially conventional and forms no part of the present invention.

FIGS. 1 through 3 also illustrate that bag 10 is provided with an inflatable rim 16 defining a chamber 18 which extends around open end 11 of the bag. As best visualized from FIG. 3, inflatable rim 16 is formed by turning a selected portion (not numbered) of the open end of the bag inside out and then heat sealing a selected exposed portion 20 of the outturned open end of the bag to an underlying surface 22 of sidewall 12. While the aforementioned is the preferred way of forming and/or attaching an inflatable rim to the open end of the bag, other means for providing such are considered to be within the scope of the present invention.

FIG. 3 also illustrates that inflatable rim 16 is provided with a sealable inflating means or sealable stem-like member 24. Stem-like member 24 has a first end 26 and a second end 28 which are in communication with each other via an internal passageway 30 defined by stem-like member 24. Stem-like member 24 is also made from a flexible heat sealable material so that second end 28 can be heat sealably attached to a portion of the inflatable rim defining an aperture 32 which extends through the wall (not numbered) of inflatable rim 16. As such, passageway 30 of stem-like member 24 is in communication with chamber 18 of inflatable rim 16, thereby rendering chamber 18 capable of receiving air via passageway 30. This enables inflatable rim 16 to be inflated and thereby maintain open end 11 of the bag in an open position. Accordingly, when inflatable rim 16 is inflated open end 11 defines an opening 34 for receiving matter such as trash, leaves, etc., to be deposited in the bag.

The ease with which bag 10 may be used will be readily appreciated by those skilled in the relevant art. After removing the bag from the package in which it is sold, one simply places his lips about end 26 of stem-like member 24 and then exhales or blows air through stem-like member 24. The air passes through passageway 30 into chamber 18 to inflate rim 16. No more than a few breaths of the individual are required to fully inflate inflatable rim 16 since chamber 18 is relatively small, i.e., it occupies a relatively small space. The individual then seals rim 16 to prevent it from deflating. This can be done by simply tying stem-like member 24 into the knot (i.e., knot 36) which is illustrated in FIG. 3. Bag 10 is now ready for filling with trash, leaves or other refuse.

Bag 10 of the present invention is ideally suited for the collection of leaves and the like, even when bag 10 is lying flat on the ground. One only needs to make sure that opening 34 is facing upwardly when the bag is lying on the ground. One then simply rakes a desired amount of leaves onto opening 34 and then lifts rim 16 (now inflated) off the ground so that the leaves in opening 34 fall into the bottom of the bag. In most cases, this initial filling of the bag will only partially fill the bag. However, it facilitates complete filling of the bag since it directs this initial deposit of leaves into the bottom of the bag, thereby making room for the next deposit of leaves into the bag.

Figure 4:
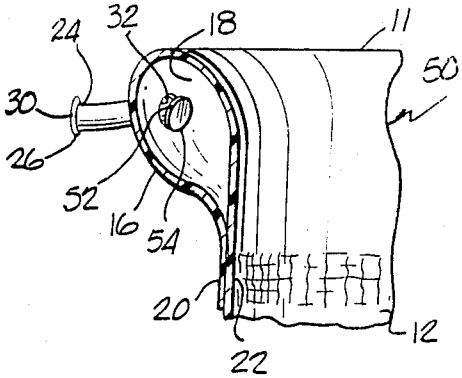
FIG. 4 is a cross-sectional view similar to that of FIG. 3 illustrating an alternative embodiment of the present invention which is provided with a sealing flap for sealing the inflatable rim after it has been inflated.

FIG. 4 partially illustrates an alternative embodiment of a bag 50 of the present invention which is identical to bag 10 except that bag 50 is additionally provided with a sealing flap 52 for sealingly covering aperture 32 to prevent inflatable rim 16 from deflating after it is inflated. Sealing flap 52 is attached at its edge 54 to a portion of the inflatable rim adjacent aperture 32. Flap 52 is also sized to cover the entire area defined by aperture 32 so that it will seal against aperture 32 after rim 16 is inflated. Flap 52 seals against aperture 32 because the air pressure generated in chamber 18 by inflating inflatable rim 16 forces the flap up against aperture 32. As such, air within chamber 18 of inflatable rim 16 is prevented from escaping through passageway 30 defined by stem-like member 24.

Sealing flap 52 may be desirable in some situations since it obviates the need for tying stem-like member 24 into a knot in order to seal rim 16. Moreover, since there is no need to tie stem 24, stem 24 can be made from a shorter length of tube, thereby reducing material costs.

While two embodiments for sealing inflatable rim 16 are illustrated, it should be understood that the present invention is not intended to be limited in any way to either of the sealing means illustrated. Nor is the invention intended to be limited in any respect to any of the other particular features and aspects of the embodiments illustrated herein. It will be understood that many modifications can be effected within the spirit and scope of this invention.

What is claimed:

1. A bag comprising:

a flexible bag body having an open end; and inflatable means located at said open end for maintaining said open end in an open position so that matter can be deposited into said bag body through said open end, said inflatable means including a chamber-defining, inflatable rim extending substantially around said open bag body.

2. A bag as claimed in claim 1 wherein said bag body and inflatable rim are made from a single sheet of flexible, heat sealable material.

3. A bag as claimed in claim 2 wherein said flexible heat sealable material is a member selected from the group consisting of vinyl, polyethylene, plastic coated materials and rubberized materials.

4. A bag as claimed in claim 1 wherein said inflatable rim includes sealable inflating means for preventing said inflatable rim from deflating after it has been inflated.

5. A bag as claimed in claim 4 wherein said sealable inflating means includes a stem-like member defining a passageway in communication with the interior of said inflatable rim, said stem-like member being connectable to a source of air for inflating said inflatable means.

6. A bag as claimed in claim 5 wherein said stem-like member is flexible and provided with a length which enables said stem-like member to be tied into a knot to seal said inflatable rim after said inflatable rim has been inflated.

7. A bag as claimed in claim 5 wherein said stem-like means includes a sealing flap for sealingly covering an aperture in said inflatable means to prevent said inflatable rim from deflating after said inflatable rim is inflated.

8. A bag as claimed in claim 4 wherein said sealable inflating means includes valve means for inflating and sealing said inflatable rim.

9. A bag as claimed in claim 1 wherein said inflatable rim is integral with said bag body.

10. A bag as claimed in claim 1 wherein said inflatable rim is formed by:

turning a selected portion of said open end of said bag body inside out;

heat sealing an exposed portion of said outturned open end to an underlying surface of said bag body to define said inflatable rim extending around said open end of said bag body; and providing inflating means communication with a chamber defined by said inflatable rim for inflating said inflatable rim.

11. A bag as claimed in claim 10 wherein said inflating means includes a sealable stem-like member defining a passageway in communication with said chamber.

12. A method of providing a flexible bag having an open end with an inflatable rim extending substantially around the bag's open end, said method comprising the steps of:

turning a selected portion of the open end of the bag inside out;

heat sealing a selected exposed portion of the outturned open end to an underlying surface of the bag to define an inflatable rim which extends around the open end of the bag; and providing inflating means in communication with a chamber defined by the inflatable rim for receiving air to inflate the inflatable rim.

13. A method as claimed in claim 12 wherein said step of providing inflating means includes sealably attaching a sealable stem-like member defining a passageway to a portion of the inflatable rim defining an aperture extending into the inflatable rim so that the passageway is in communication with the chamber defined by the inflatable rim.

14. A method as claimed in claim 13 further comprising the step of:

providing a sealing flap for sealingly covering the aperture of the inflatable rim when the inflatable rim is inflated, the sealing flap thereby prevention the inflatable rim from deflating after it has been inflated.

15. A flexible bag such as a trash bag comprising:

a bottom, an inflatable rim and a single layered sidewall extending between said bottom and said inflatable rim, said inflatable rim defining an open end of the bag which open end, in turn, defines an opening for receiving matter to be deposited in the bag when said inflatable rim is inflated.

16. A bag as claimed in claim 15 wherein said single layered sidewall is a flexible multi-ply laminate.

* * * * *

UNITED STATES PATENT AND TRADEMARK OFFICE

CERTIFICATE OF CORRECTION

PATENT NO. : 4,867,576

DATED : September 19, 1989

INVENTOR(S) : E. Gordon Boyd

It is certified that error appears in the above-identified patent and that said Letters Patent is hereby corrected as shown below:

Column 2, line 9, "des" should read --designating--.

Column 2, line 11, after "present" insert --invention--.

Column 2, line 15, after "rim" insert --of--.

Column 4, claim 1, line 2, after "open" insert --end of said--.

Column 4, claim 10, line 41, after "means" insert --in--.

Column 5, claim 14, line 3, "prevention" should read --preventing--.

Signed and Sealed this

Tenth Day of July, 1990

*Attest:*

HARRY F. MANBECK, JR.

*Attesting Officer*

*Commissioner of Patents and Trademarks*